United States Patent [19]

Nambu et al.

[11] Patent Number: 4,660,298

[45] Date of Patent: Apr. 28, 1987

[54] PROCESS FOR THE TEMPERATURE CONTROL OF A DRYING APPARATUS

[75] Inventors: Yutaka Nambu; Hitosi Sugawara; Yasuo Saitoh, all of Hiratsuka, Japan

[73] Assignee: The Japan Tobacco & Salt Public Corporation, Tokyo, Japan

[21] Appl. No.: 676,640

[22] Filed: Nov. 30, 1984

[30] Foreign Application Priority Data

Dec. 2, 1983 [JP] Japan ..... 58-227024

[51] Int. Cl.[4] ..... F26B 3/00

[52] U.S. Cl. ..... 34/30; 34/48; 34/46

[58] Field of Search ..... 34/30, 48, 46, 135, 34/142; 131/303

[56] References Cited

U.S. PATENT DOCUMENTS

| | | | |
|---|---|---|---|
| 2,644,681 | 7/1953 | Scull et al. | 34/48 |
| 3,204,341 | 9/1965 | Whitsel | 34/48 |
| 3,219,329 | 11/1965 | Goins | 34/46 |
| 3,350,790 | 11/1967 | Whitsel | 34/48 |
| 3,499,229 | 3/1970 | Roberts | 34/23 |
| 4,170,073 | 10/1979 | Ignatowicz | 131/303 |
| 4,251,925 | 2/1981 | Muhsil et al. . | |
| 4,346,524 | 8/1982 | Wochnowski et al. | 131/303 |
| 4,498,864 | 2/1985 | Roth et al. | 34/48 |
| 4,513,759 | 4/1985 | Wochnowski et al. | 131/303 |

FOREIGN PATENT DOCUMENTS

| | | |
|---|---|---|
| 1532069 | 2/1970 | Fed. Rep. of Germany . |
| 1295645 | 11/1969 | United Kingdom . |
| 1504647 | 9/1976 | United Kingdom . |

*Primary Examiner*—Albert J. Makay
*Assistant Examiner*—David W. Westphal
*Attorney, Agent, or Firm*—Balogh, Osann, Kramer, Dvorak, Genova & Traub

[57] ABSTRACT

A process for controlling the temperature of a drying apparatus including a cylindrical rotor having a plurality of heating means which are independent of each other and arrayed in an advance direction of raw material, the process comprises controlling the heating means in response to measurements of the flow rate and moisture content of the raw material charged into the rotor and measurements of temperatures of respective sections of the rotor, each section corresponding to each heating means so that the temperature of each section is changed in accordance with a flow rate characteristics curve of each section and controlling the heating means so that a bias temperature for compensating for a lag in thermal response dead time of each heating means is applied prior to changing the temperature of each section in accordance with a flow rate characteristics curve by a feed back controlling at least a final heating means in response to the measurement of the moisture content of the dried raw material discharged from the rotor.

2 Claims, 11 Drawing Figures

PROCESS FOR THE TEMPERATURE CONTROL OF A DRYING APPARATUS

BACKGROUND OF THE INVENTION

The present invention relates to a process for temperature control, and in particular to a process for the temperature control of a drying apparatus in which the raw material which has been charged into the entrance thereof is dried so that the moisture rate of the raw material is kept constant and is discharged from the exit thereof.

For example, when cut tobacco leaves are dried, it is desirable that the finished product possess a predetermined moisture.

The period of time after the raw material cut tobacco leaves is charged into the drying apparatus until the amount of the raw material held at each part of the drying apparatus is stabilized to a substantially constant state, that is, the flow rate of the raw material at the exit of the drying apparatus is stabilized is referred to rise-up time or unsteady time, which differs from the subsequent period referred to as stable time or steady time.

If a similer temperature control is carried out during both periods, drying would be excessive at rise-up time and final product would not possess the desired moisture. For example if the period of the rise-up time is 10 to 15 minutes in a drying apparatus into which raw material is supplied at a flow rate of 6000 kg/h, there is a possibility of production of 50 to 100 kg of undesired product.

SUMMARY OF THE INVENTION

The present invention was made for overcoming the problem of the prior art. It is an object of the present invention to provide a process for controlling the temperature of a drying apparatus.

In one aspect of the present invention there is provided a process for controlling the temperature of a drying apparatus including a cylindrical rotor having a plurality of heating means which are independent of each other and arrayed in an advance direction of raw material, the process comprising controlling the heating means in response to the measurements of a flow rate and a moisture content of the raw material charged into the rotor and measurements of the temperatures of respective sections of the rotor, each section corresponding to each heating means so that the temperature of each section is changed in accordance with a flow rate characteristics curve of each section and controlling the heating means so that a bias temperature for compensating for a lag in thermal response of each heating means is applied prior to changing the temperature of each section in accordance with a flow rate characteristics curve by a feed back controlling at least a final heating means in response to the measurement of the moisture rate of the dried raw material discharged from the rotor.

The flow rate characteristics curve is determined by the time of passage of the raw material and its effect on the initial temperature in each section. A lag in thermal response of the heater means is that the heater means does not start to heat the raw material immediately after the heat control is started upon arrival of the raw material. A bias temperature for compensating a lag in thermal response is set to preheat the raw material in a predetermined period prior to the arrival of raw material at each section of the drying apparatus.

In another aspect of the present invention there is provided a process for controlling the temperature of a drying apparatus including a cylindrical rotor having a plurality of heating means which are independent of each other and arrayed in an advance direction of raw material, the process comprising keeping the temperature of the drying apparatus at a predetermined temperature prior to the drying operation of the raw material and then controlling the heating means in response to measurements of the flow rate and moisture content of the raw material charged into said rotor and in response to measurements of the temperature of respective sections of the rotor, each section corresponding to each heating means so that prior to changing the temperature of each section in accordance with a flow rate characteristics curve by feed back controlling at least a final heating means in response to the measurement of the moisture rate of the dried raw material discharged from the rotor.

DETAILED DESCRIPTION OF THE EMBODIMENTS

The present invention will be described by way of embodiments with reference to the drawings.

Figure 1:
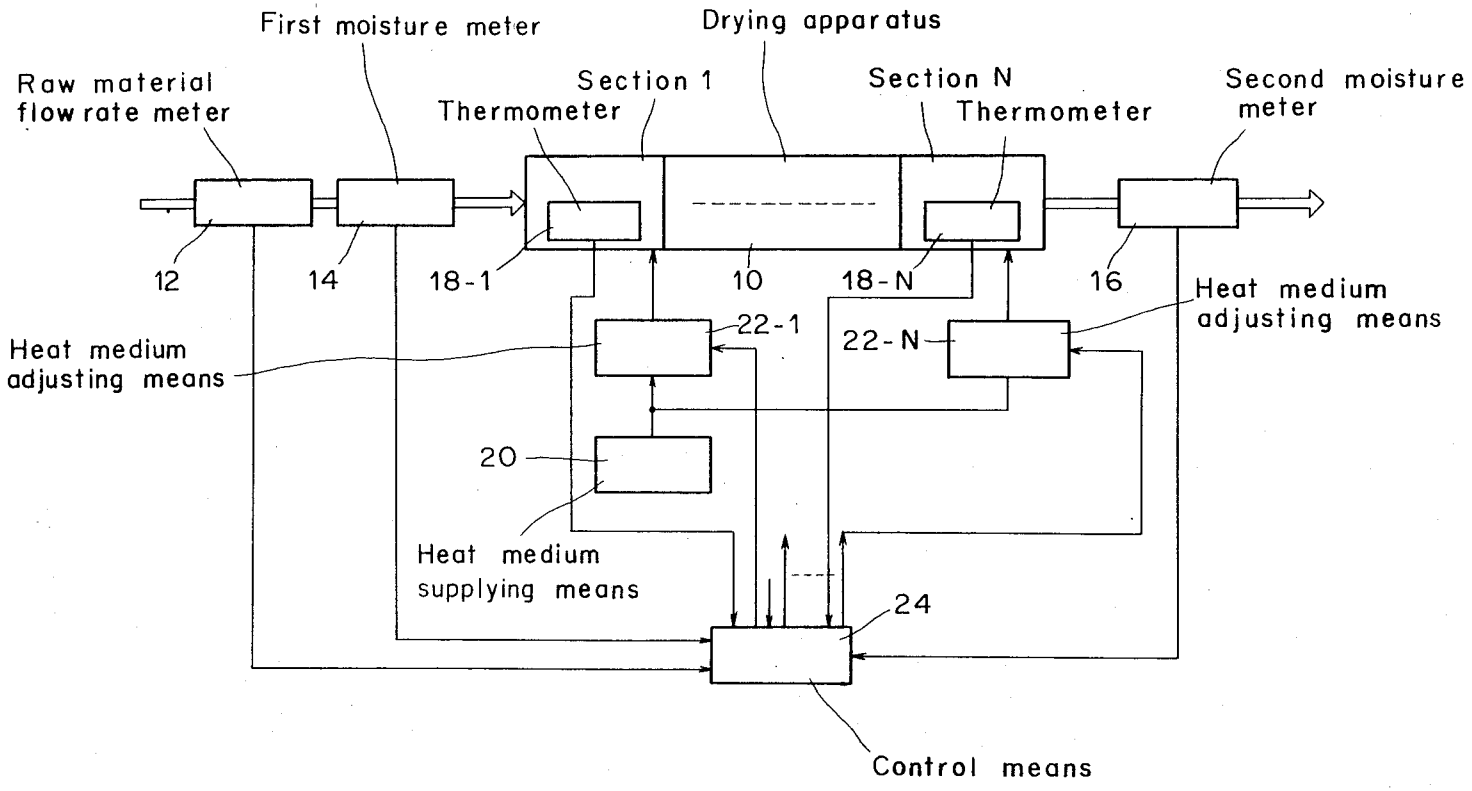
FIG. 1 is a block diagram showing a drying apparatus for carrying out a process of the present invention.

Referring to FIG. 1, there is shown a schematic structure of the system for accomplishing a process of the present invention. Reference numeral 10 represents a drying apparatus comprising a cylindrical rotor having a plurality of heater means (not shown) which are independent of each other and arranged in a raw material feeding direction. The rotor of the drying apparatus may be deemed as being divided into a plurality of dryhing sections 1 to N corresponding to respective heating means. Reference numerals 12 and 14 represent a raw materials flow rate meter and a first moisture meter respectively. The flow rate meter 12 and the first moisture meter 14 are disposed outside the entrance of the drying machine 10 for determining the flow rate and the moisture content of the raw material charged into the drying apparatus 10. A second moisture meter 16 is disposed outside the exit of the drying apparatus 10 for determining the moisture content of the raw material which has been dried by the drying apparatus 10. Thermometers 18-1 to 18-N are provided at the drying sections 1 to N for determining the temperature thereof. Reference numeral 20 represents means supply for supplying heat medium for the purpose of drying which supply means are connected with the heater means in each section of the drying apparatus. The heat medium is supplied in the form of steam in this embodiment. Heat medium adjusting means 22-1 to 22-N which are disposed between the heat medium supplying means 20 and the heater means in each section are adapted to adjust the supply of the heat medium to each heater means in the drying sections 1 to N from the heat medium supply means 20 under the control of the control means 24 which will be described hereafter.

The heater means comprises heating pipes and the heat medium adjusting means 22-1 to 22-N comprise diaphragm valves if the heat medium is steam as described above.

The cylindrical rotor which forms the drying apparatus is tilted so that the entrance is slightly higher. When the rotor is driven to rotate by means of rollers (not shown) the rotor serves to move the raw material which has been charged into the entrance thereof toward the exit and to dry the raw material into a given moisture content and to discharge it from the exit.

The control means 24 comprises an electronic computer such as microcomputer. The control means 24 receives signals from the raw material flow rate meter 12, the first moisture meter 14, the second moisture meter 16 and thermometers 18-1 to 18-N. The control means 24 controls the heat medium adjusting means 22-1 to 22-N by arithmetically processing the signals in accordance with a predetermined program. In other words, the control means 24 generates control signals for opening or closing the diaphragm valves. The outline of the structure will be described with reference to FIG. 2.

Figure 2:
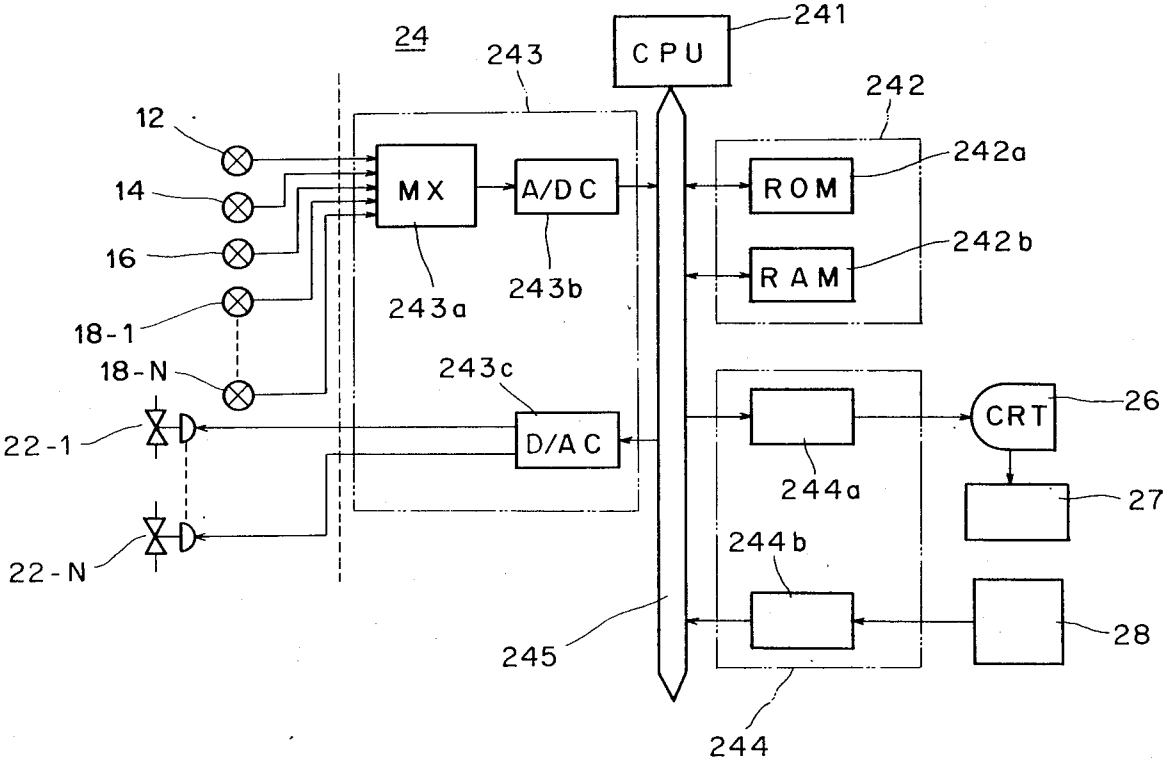
FIG. 2 is a block diagram showing an embodiment of control means shown in FIG. 1.

In FIG. 2 reference numeral 241 represents a central processing unit (hereinafter referred to as CPU) which carries out control of jobs which are executed in accordance with a program, arithmetic processing which is necessary in the execution of jobs and control of other devices and management of reception and feeding of the data required for this control.

A memory device 242 comprises a read only memory **242*a* (hereafter referred to as ROM) which stores a program for fixed jobs which the computer executes and a read and write memory 242*b*** (hereafter referred to as RAM) which stores constants required for program, operation results and input information.

A process input/output device 243 comprises a multiplexer **243*a* (hereinafter referred to as MX) which subsequently switches the analog input signals from the raw material flow rate meter 12, the first moisture meter 14, the second moisture meter 16 and the thermometers 22-1 to 22-N, an analog to digital converter 243*b* (hereafter referred to as A/D C) which converts the signals from the multiplexer 243*a* into analog signals which may be processed by the computer and digital to analog converter 243*c* (hereafter referred to as D/A C) which converts the digital information obtained by arithmetic processing in the computer into an analog output for actuating the diaphragm valves 22-1 to 22-N**.

An input/output device 244 comprises a serial interface **244*a* which provides video information and input data to a CRT display 26 and receives and feeds the data from and to the computer when the data is printed out by a printer 27 and a keyboard input device 244*b* which transforms the data from keyboard 28 operated for storing constants by an operator and transmits them to CPC 241**.

Reference numeral 245 represents an data but through which various data are received and fed among the aforementioned devices.

The temperature control by the control device 24 will be described in detail with reference to FIG. 3 and the following figures.

Figure 3:
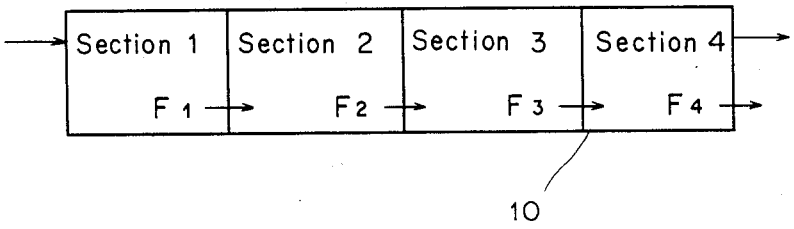
FIG. 3 is a schematic diagram illustrating an example of the drying apparatus.
Figure 4:
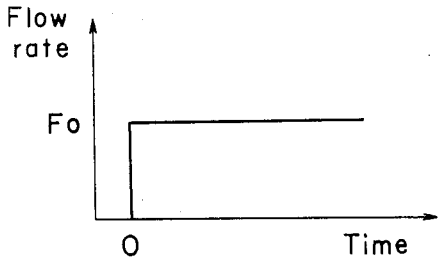
FIG. 4 is a graph showing the change in flow rate of the raw material charged into the drying apparatus shwon in FIG. 3.
Figure 5:
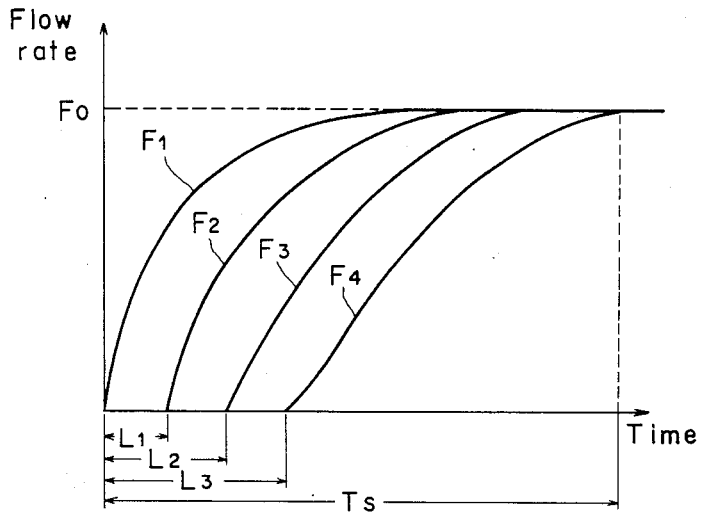
FIG. 5 is a graph showing the change in flow rate at a given position of each section when the raw material is charged at a flow rate shown in FIG. 4.

When flow rate of the raw material cut tobacco leaves at the entrance rises up to $F_0$ as shown in FIG. 4 in the drying apparatus 10 which are divided into four drying sections 1 to 4 as shown in FIG. 3, the flow rates $F_1$, $F_2$, $F_3$ and $F_4$ at each drying section on raw material charging change as shown in FIG. 5.

In FIG. 5, $L_1$, $L_2$ and $L_3$ represent the time it takes for the raw material to pass the length between the drying apparatus entrance and the section 2, the length between the drying apparatus entrance and the section 3 and the length between the drying apparatus entrance and the section 4 respectively. Ts represents a time until the flow rate at each section reaches at the steady flow rate $F_0$ which is referred to as setting time. The flow rate curves $F_1$, $F_2$, $F_3$ and $F_4$ are approximated by omitting $L_1$, $L_2$ and $L_3$ as follows;

$$F_i(s) = \frac{F_0}{(1 + T\alpha i \cdot s) \cdot s} \tag{1}$$

In the formula, i represents 1 to 4, $T\alpha i$ represents flow rate characteristics constant and s a Laplacian operator. The temperature $T_{A0}$ at each section for making the moisture at the exit of the driving apparatus to a constant value under the condition at which $F_1$ to $F_4$ reach at a constant flow rate $F_0$ after the passage of the period $T_s$ may be represented as follows;

$$T_{A0} = \alpha F_0 + \beta \cdot \omega_1 - \delta \tag{2}$$

wherein $\omega_1$ represents a moisture content of the raw material which is obtained from the first moisture meter 14 in FIG. 1. The constant flow rate $F_0$ is obtained by the raw material flow rate meter 12. $\alpha$, $\beta$ and $\delta$ represent operation parameters.

Figure 6:
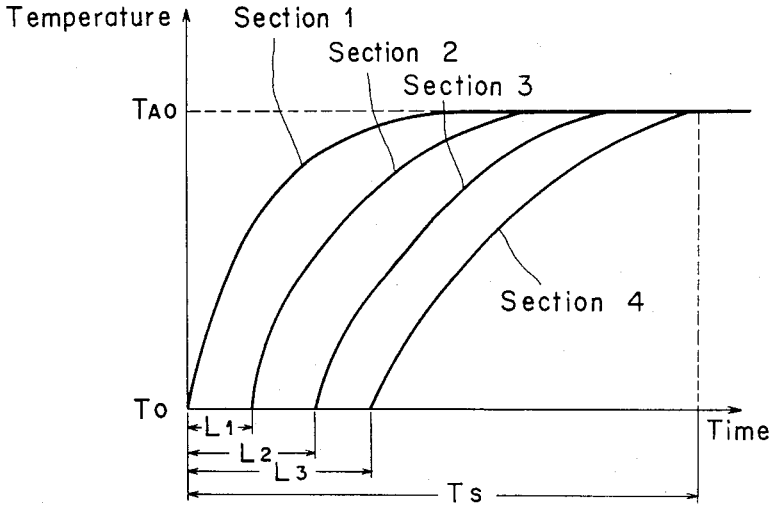
FIG. 6 is a graph showing the change in temperature at each section depending upon the change in flow rate of FIG. 5.

If the temperature at each section immediately before charging of the raw material is assumed as $T_0$, a target moisture content may be obtained at the exit of the drying apparatus immediately after rise-up of the raw material by raising the temperature at each section to $T_{A0}$ represented by the formula (2) by tracking the curves in FIG. 6 which are similar to those in FIG. 5.

If the optimum drying temperature curve $T_{Ai}(t)$ until reaching at $T_{A0}$ at each section is deemed as $\Delta T_{Ai}(s)$ by omitting $L_1$, $L_2$ and $L_3$, the $\Delta T_{Ai}(s)$ is represented as follows;

$$\Delta T_{Ai}(s) = \mathcal{L}\{T_{Ai}(t) - T_0\} = \frac{T_{A0} - T_0}{(1 + T\alpha i \cdot s) \cdot s} \tag{3}$$

wherein $\mathcal{L}$ represents a Laplacian transformation operation.

Figure 7:
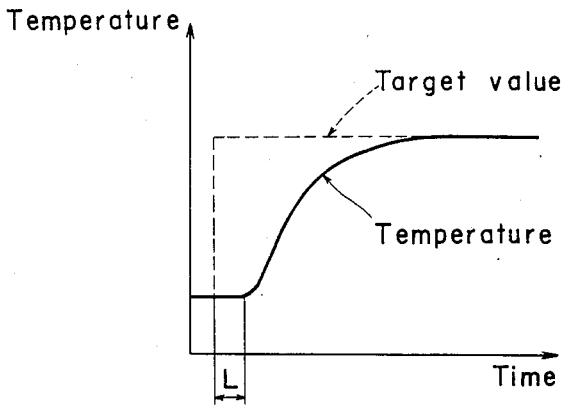
FIG. 7 is a graph showing the thermal response characteristics of each section.

The temperature response curves at each section change as shown in FIG. 7 when the target value of the temperature at each drying section is stepwise changed. If the target value, thermal transfer characteristics of temperature response among sections and the temperature of the section and represented as $T_{sv}(s)$, G(s) and $T_A(s)$ respectively by using Laplacian operator the following relation is established.

$$G(s) = \frac{T_A(s)}{T_{sv}(s)} \tag{4}$$

The transfer characteristics $G_i(s)$ of each section is represented from the FIG. 7 as follows:

$$G_i(s) = \frac{1}{1 + T\beta i \cdot s} \tag{5}$$

wherein $T\beta i$ represents a constant of the thermal response characteristics at each sections. Lag in thermal response is omitted from the formula (5).

From the formulae (3) to (5) the present temperature T*SETi for providing the optimum drying temperature $T_A$ at each drying section is represented by the formulae (6), (7) and (8).

$$T^*SETi = Tsvi \tag{6}$$

$$TSET = T_{A0} = \mathcal{L} \cdot F_0 + \beta\omega_1 - \delta \tag{7}$$

$$T^*SETi = T_{A0} - \frac{(T_{A0} - T_0)(T\alpha i - T\beta i)}{T\alpha i} \cdot e^{(-t/T\alpha i)} \tag{8}$$

The formula (8) may be obtained by reverse-transforming $T_{sv}(s)$ which is obtained by putting the above formulae (3) and (5) into the formula (4).

Figure 8:
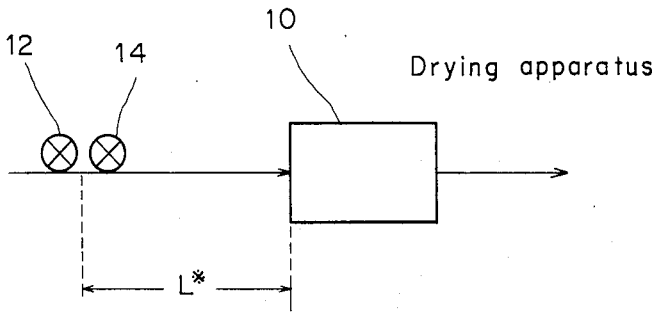
FIG. 8 is an explanatory view showing the relation of position of a flow rate meter and moisture meter with respect to the drying apparatus.
Figure 9:
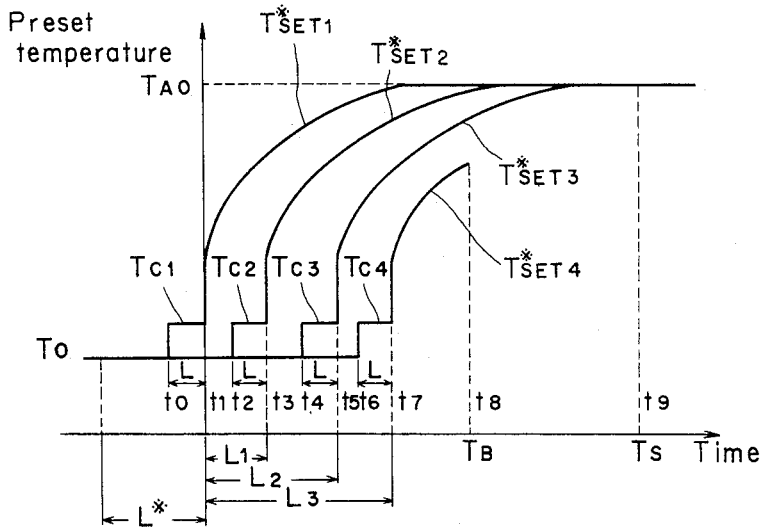
FIG. 9 is a graph showing preset temperature for changing the temperature of each section in accordance with the curves shown in FIG. 6.

Since the raw material flow rate meter 12 which is disposed together with the first moisture meter 14 at the entrance side of the drying apparatus is positioned upstream of the entrance by a length L* as shown in FIG. 8, it takes time for the raw material detected by the flow rate meter 12 to reach the exit of the drying apparatus. The length L* corresponding to this time is known. Accordingly, a bias temperature $T_{cl}$ is preliminarily preset at an interval $t_0$ to $t_1$ before the reaching of the raw material as shown in FIG. 9 in order to raise the temperature of the driving section 1 at the time then the raw material reaches at the entrance of the drying apparatus 10 by correcting a lag in thermal response T in rise-up of the temperature at the drying section, which has been described hereabove. As similarly, bias temperatures $T_{c2}$, $T_{c3}$ and $T_{c4}$ are initially preset between intervals $t_2$ to $t_3$, $t_4$ to $t_5$, $t_6$ to $t_7$ with respect to the sections 2 to 4 respectively.

In connection with the sections 1 to 3, preset temperatures $T^*SET_1$, $T^*SET_2$ and $T^*SET_3$ which are obtained by the above-mentioned formula 8 are preset for the intervals $t_1$ to $t_9$, $t_3$ to $t_9$, and $t_5$ to $t_9$ respectively in FIG. 9. A preset temperature $T^*SET_4$ by the formula 8 is preset only the interval $t_7$ to $t_8$ in connection with the section 4. Other temperature presetting is accomplished for the time $T_8$ and following time.

In operation the moisture rate of the dried raw material is sequentially measured by the second moisture meter 16 at the output side of the drying apparatus 10. The drying temperature is controlled so that the measured signal $\omega_2$ becomes a target moisture rate $\omega^*$. Such control is a feedback control. Since the control is carried out while measuring a true moisture rate, the target moisture rate may be assured.

Since the temperature presetting at each section depends upon the forecast method in which a target moisture rate may be obtained upon basis of a model formula in which the flow rate time constant characteristics and then thermal response characteristics etc. are approximated. The errors in the model formula and other disturbance are of course involved so that there is a possibility that the moisture content of the dried raw material becomes a target moisture content. It is therefore an object of such control to correct the errors.

Temperature $T_{A0}$ is preset after a time $t_9$ in accordance with the formula (2) in connection with the sections 1 to 3. This control is carried out in a steady state and referred to as feed forward control. Feed back control is continued in the section 4.

Since the actual temperature adjustment is carried out by opening and closing the diaphragm valves even if the temperature is preset by the aforementioned preset temperature $T^*SET_1$ to $T^*SET_4$, a valve opening signal $m_i$ is obtained by carrying out the adjustment operation of the following formula (9), that is, proportion, integration and differential (PID) operation $$m_i = K_p\left\{(Tsvi - Ti) + \frac{1}{T_I}\int_0^t (Tsvi - Ti)dt + T_D\frac{(Tsvi - Ti)}{dt}\right\} \tag{9}$$

wherein $K_p$, $T_1$ and $T_0$ represent operation parameters referred to as proportional gain, differential time and integration time repectively and $T_i$ represents temperature measuring signals from the thermometers 18-1 to 18-4. For the feed back control period, a target temperature signal $m_5$ of the heating pipe corresponding to the section 4 is obtained by the PID operation of a following formula (10).

$$m_5 = K_p\left\{(\omega^* - \omega_2) + \frac{1}{T_I}\int(\omega^* - \omega_2)dt + T_D\frac{d(\omega^* - \omega_2)}{dt}\right\} \tag{10}$$

The valves corresponding to the sections 1 to 4 is opened or closed at an opening which is obtained by the above formula (9) and the valve corresponding to the section 4 is opened or closed at an opening obtained in accordance with the formula (9) by a cascade control in which $Tsv_i$ is preset by a target temperature signal obtained by the above formula (10). By doing so, the moisture content at the rise-up of the raw material may be quickly changed to a target value soon.

The constants $T\alpha_1$, $T\alpha_2$, $T\alpha_3$ and $T\alpha_4$ of the flow rate characteristics are determined by assumption of the results of a fundamental experiment upon basis of the constant $T\alpha_4$ of the flow rate characteristics $F_4$ of FIG. 5. In practice, $T\alpha_1$, $T\alpha_2$ and $T\alpha_3$ are obtained by multiplying $T\alpha_4$ with a factor.

If the temperature $T_0$ of the drying apparatus just before when the raw material is charged into the drying machine is various depending upon the working beginning time and the environmental conditions, the condition becomes complicated and it is difficult to provide a good reproduction for controlling the moisture rate on raw material charging.

Figure 10:
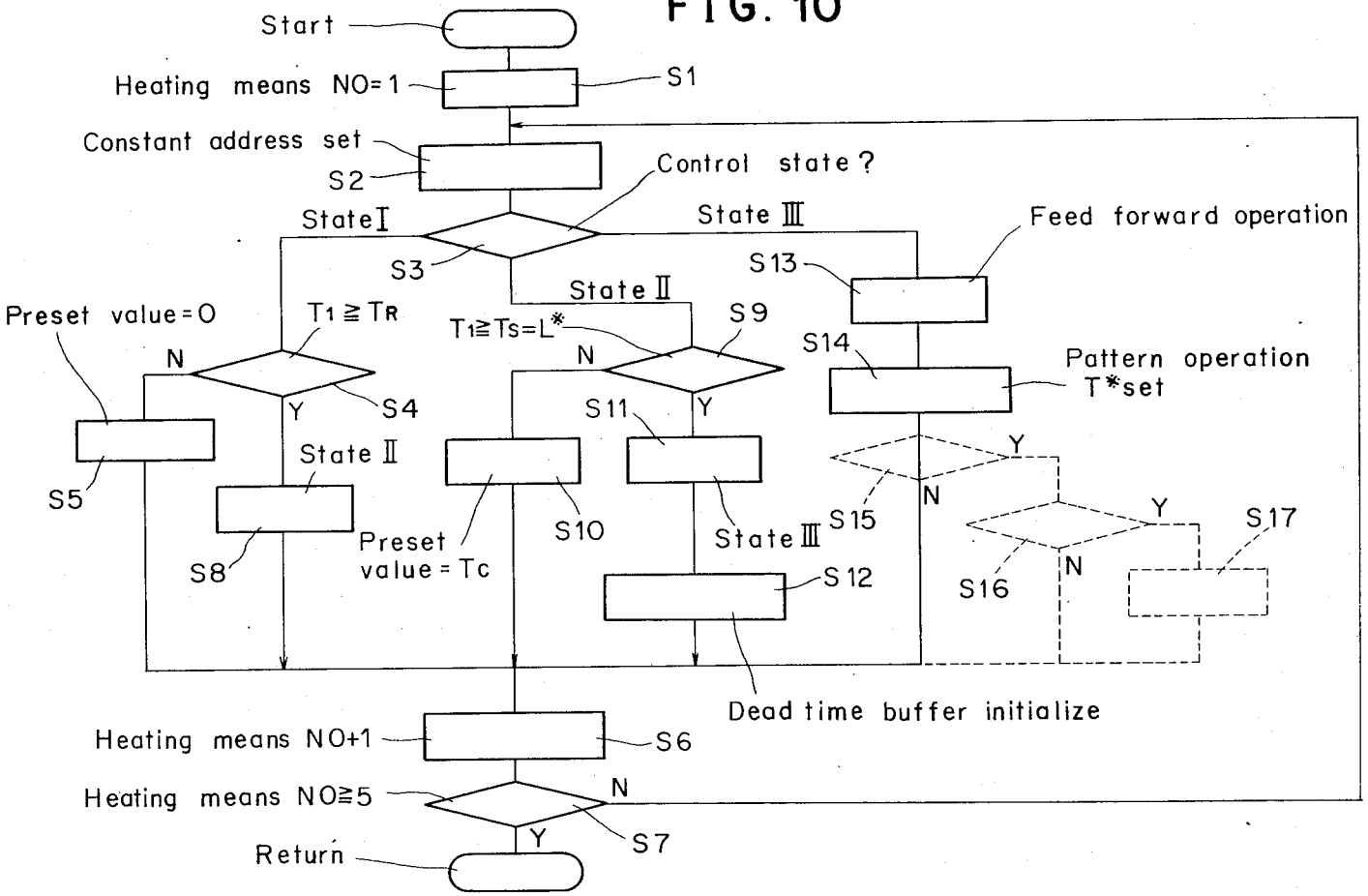
FIG. 10 is a flow chart for carrying out the process of the present invention by means of a computer shown in FIG. 2.

FIG. 10 is a flow chart showing a program for the aforementioned control which the control means 24 executes.

When the program is started in response to the detection of the raw material by the flow rate meter 12 in the shown chart, the heating means No. is set to 1 at step S1. That is, this setting appoints the control corresponding to the section 1. Following this, data are read out by addressing the RAM (represented as 242*b* in FIG. 2) which stores the constants relating to the control of the heating means No. 1 at step S2. The program then goes to step 3 at which it determines what control state is.

Figure 11:
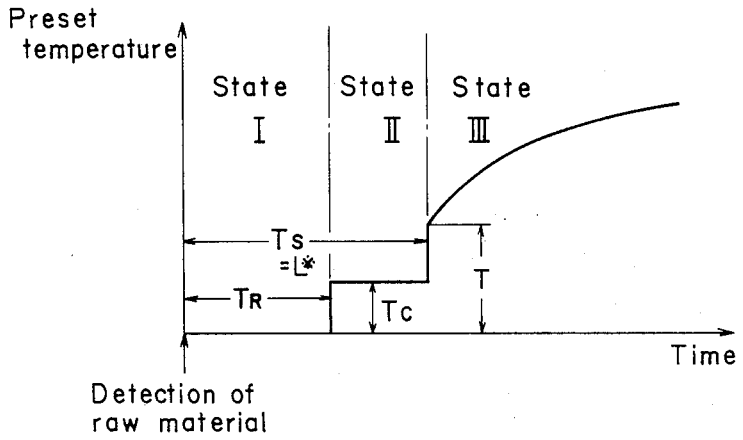
FIG. 11 is a graph for explaining the definition of control states.

The control state used herein includes three controls I to III which begin with the detection of the raw material as shown in FIG. 11. The term $T_R$ until a bias temperature $T_{ci}$ is preset since the detection of the raw material is defined as state I. A bias temperature preset term $T_s$ to $T_R$ is defined as state II and a term after the completion of the state II is defined as state III. Since the determination at step S3 just after start is state I, the program then proceeds to step S4. At step S4, it is determined whether or not the time after start is larger than $T_R$. The time $T_1$ is represented by the content of the counter which counts 1 per one second since the detection of the raw material.

Since the time is just after the program start, of course, $T<T_R$. The result of determination is no and the program goes to step S5.

The temperature preset value T*SET is set to 0 at step S5. The program then goes to step S6 at which the heating means No. is added with 1 so that the heating means No is changed to 2. It is determined whether or not the heating means No is larger than 5 at next step S7. Since the result of determination is no, the program returns to step S2. Data is read out by addressing the RAM which stores the constants relating to the control of the heating means No. 2 at step S2. The program goes to step S6 through the steps S3, S4 and S5. The heating means No. is changed to 3 at step S6. The program then goes to step S6 again through the steps S7, S2, S3, S4 and S5. The heating means No. is changed to 4 at step S6. The program returns to step S6 again through steps S7, S2, S3, S4 and S5. The heating means No. is changed to 5. The program goes to step S7. The result of the determination at step S7 is yes, the program returns to start. However, the restart is waited until one second has passed since the previous start.

The program is restarted after the passage of one second and goes to step S7 through the aforementioned steps S1, S2, S3, S4, S5 and S6. The jobs of steps S2 to S6 are repeated as is similar to aforementioned case until the heating means No. becomes 5. When the heating means No. becomes 5 the program returns to start.

If the $T_{R1}$ of the heating means No. 1 is assumed to be 8 seconds the above-mentioned jobs would repeated 8 times. When the determination at step S4 is yes, the program goes to step S8. The control state of heating means No. 1 is set to state II. Then the program goes to step S6 at which the heating means No. is set to 2. Thereafter the program goes to step S4 through steps S2 and S3.

Even if the heating No. 1 is 8, the determination at step S4 is No since the $T_R$ of the heating means No. 2, No. 3 and No. 4 is the times which are added with $L_1$, $L_2$ and $L_3$ (refer to FIG. 9) respectively. Thereafter the heating means No. is 5 and the jobs are executed via steps S4, S5 etc. until the program is restarted.

The program is then restarted and the heating means No. is set to 1 at step S1. The determination on the control state is carried out at next step S2. Since the result of determination is started II, the program will go to step S9 at which determination whether $T \geqq T_S$ or not is carried out. Since the determination result is No, the temperature preset value $T^*SET_1$ is set to a bias temperature $T_c$ at next step S10.

Thereafter the heating means No. is set to 2 at step S6. The program will return to step S6 through steps S7, S2, S3, S4 and S5 until the heating means No. is changed to 5. If the determination results is yes at next step 7, the program will return to start.

Until the period $T_s$ has passed, loop job is carried out via the steps S1, S2, S3, S9, S10, S6 and S7 as to the heating means NO. and the loop job is carried out via the steps S2, S3, S4, S6 and S7 as to the heating means Nos. 2, 3 and 4.

If the period $T_s$ has passed, the determination result would be No at step S9 and the program will go to step S11 at which the control state of the heating means No. 1 is set to state III. Thereafter the program will go to step S12 at which actuation of RAM which stores data is carried out so that the data on the raw material flow rate $F_0$ and the moisture control $\omega_1$ collected before by a dead time $T_s$ become initial data for control. Then the program will go to the step S7 via the step S6. The loop job of steps S2 to S7 as to heating means Nos. 2 to 4 until the heating means No. becomes 5. When the heating means No. becomes 5, the program will return to START.

The heating means No. is set to 1 at step S1 again. The program will then go to step S3 via step S2. Determination on control state is carried out at step S2. Since the determiantion result is state III, the program will go to step 13 at which feed forward operation shown in the formula (2) is carried out upon basis of the data which have been initialized at the step 12 and constants so that the final desired or target value $T_{A0}$ is calculated. The program then goes to step 14 at which pattern operation shown in the formula (8) is carried out so that $T^*SET_1$ is set. The preset temperature T*SET at time $t=0$ corresponds to T in FIG. 11. The program will go to step S7 via step S6 after the operation at step S14.

Following heating means Nos. 2 to 4 will be described. As apparent from FIG. 9, jobs of steps S2 to S7 are sequentially carried out as described above since the control of the heating means Nos. 2 to 4 is still in state I when the control of the heating means No. 1 is rendered into state III. The heating means Nos. 1, 2 and 3 are rendered into states II and III after periods of time $L_1$, $L_2$ and $L_3$ have passed since the heating means No. 1 is rendered into states II and III.

Steps S15 and S17 represented by dotted line in FIG. 10 are provided for carrying out feed back control of the heating means No. 4. Determination whether or not the heating means No. is equal to 4 is carried out at step S15. Determination whether or not $T_1 \geqq T_B$ at step S16 wherein $T_B$ is a time when feed back control begins. Feed back control is accomplished at step S17.

When the process of the present invention is carried out at a cut tobacco leaves drying appratus under conditions of 12.5% wB of target moisture rate at the exit and not higher than 11.5% wB of abnormal moisture rate, the cut tobacco having an abnormal moisture content can be suppressed to a remarkably low yield as 5 kg at a total amount at 6000 kg/h of flow rate of the raw material. Furthermore the control of moisture content may be stably carried out.

Although feed back control is carried out at only final section in the above-mentioned embodiment, the same effect may be obtained by carrying out feed back control at other desired sections.

In accordance with the above-mentioned process of present invention the temperature of the drying apparatus when the raw material is charged into the drying apparatus is controlled according to the raw material flow rate characteristics and the compensation for a lag in thermal response by application of bias temperature and feed back control based on the moisture content of the dried tobacco is carried out. The production of undesired product may be minimized by changing the moisture content of the dried product at the rise-up time of drying operation of the drying apparatus to a target value as soon as possible.

What is claimed is:

1. A process for controlling the temperature of a drying apparatus including a cylindrical rotor having a plurality of heating means which are independent of each other and arrayed in an advance direction of raw material, said process comprising controlling said heating means in response to the measurements of a flow rate and a moisture content of the raw material charged into said rotor and in response to measurements of the temperatures of respective sections of the rotor, each section corresponding to each heating means so that the temperature of each section is changed in accordance with a flow rate characteristics curve of each section and controlling the heating means so that a bias temperature for compensating for a lag in thermal response of each heating means is applied prior to arrival of said raw material at each said section, and thereafter the temperature of each section is changed in accordance with said flow rate characteristics curve when said raw material arrives at said each section by a feed back controlling at least a final heating means in response to the measurement of the moisture content of the dried raw material discharged from said rotor.

2. A process for controlling the temperature of a drying apparatus including a cylindrical rotor having a plurality of heating means which are independent of each other and arrayed in an advance direction of raw material, said process comprising keeping the temperature of said drying apparatus at a predetermined temperature prior to the drying operation of the raw material and then controlling said heating means in response to measurement of a flow rate and a moisture content of the raw material charged into said rotor and in response to measurements of the temperatures of respective sections of the rotor, each section corresponding to each heating means so that the temperature of each section is changed in accordance with a flow rate characteristics curve of each section and controlling the heating means so that a bias temperature for compensating for a lag in thermal response of each heating means is applied prior to arrival of said raw material at said each section, and thereafter the temperature of each section is changed in accordance with said flow rate characteristics curve when said raw material arrives at said each section by a feed back controlling at least a final heating means in response to the measurement of the moisture content of the dried raw material discharged from said rotor.

* * * * *